US005189321A

United States Patent [19]

Seevinck

[11] Patent Number: 5,189,321

[45] Date of Patent: Feb. 23, 1993

[54] COMPANDING CURRENT-MODE TRANSCONDUCTOR-C INTEGRATOR

[75] Inventor: Evert Seevinck, Eindhoven, Netherlands

[73] Assignee: U.S. Philips Corporation, New York, N.Y.

[21] Appl. No.: 766,890

[22] Filed: Sep. 27, 1991

[30] Foreign Application Priority Data

Oct. 4, 1990 [NL] Netherlands ..... 9002154

[51] Int. Cl.[5] ..... G06G 7/10; G06G 7/18

[52] U.S. Cl. ..... 307/490; 307/261; 328/127

[58] Field of Search ..... 307/490, 520, 521, 492, 307/261; 328/127, 128

[56] References Cited

U.S. PATENT DOCUMENTS 4,293,820 10/1981 Dinh ..... 330/109
4,546,274 10/1985 Sakai ..... 328/127
4,734,598 3/1988 Böhme ..... 328/127
4,859,881 8/1989 Yamamoto et al. ..... 307/520
5,012,139 4/1991 Susak et al. ..... 307/490
5,023,489 6/1991 Macbeth ..... 307/490

*Primary Examiner*—William L. Sikes
*Assistant Examiner*—Toan Tran
*Attorney, Agent, or Firm*—Bernard Franzblau

[57] ABSTRACT

In a current-mode transconductor-C integrator, the non-linearity of the voltage-to-current conversion of a transconductor is corrected by means of a differentiator which supplies a current ($i_d$) which is proportional to the derivative of a current ($i_f$) which in turn is proportional to the transconductor output current ($i_{out}$), with respect to the transconductor control (v). An input current ($i_{in}$) is divided by the current ($i_d$) by means of a current divider. The resultant quotient current ($i_q$) is applied to an integrating capacitor across which a voltage (v) is built up. This voltage is converted into the output current ($i_{out}$) by the transconductor. This results in an output current ($i_{out}$) which is linearly proportional to the integral of the input current ($i_{in}$) without the distortion usually caused by the non-linear voltage-to-current characteristic of the transconductor.

16 Claims, 6 Drawing Sheets

COMPANDING CURRENT-MODE TRANSCONDUCTOR-C INTEGRATOR

BACKGROUND OF THE INVENTION

This invention relates to a transconductor-capacitor integrator for generating at least one output signal which is proportional to the integral of an input signal, which integrator comprises an input terminal for receiving the input signal, an output terminal for supplying the output signal, a capacitor and, coupled thereto, a transconductor having an input and an output.

Such a transconductor-C integrator is known, inter alia, from the article "A 4-MHz CMOS Continuous-Timer Filter with On-Chip Automatic Tuning", IEEE Journal of Solid State Circuits, Vol. 23, No. 3, June 1988, pp. 750–758, FIG. 1. Continuous-time filters are suitable for a variety of filter functions in the field of audio and video signal processing and as anti-alias filters in digital or switched-capacitor systems. Continuous-time filters require a transconductor-C integrator with a linear tunable transconductor. However, tuning capability and linearity cannot be combined simply. In addition, there is a need for transconductor-C integrators operating in the current mode, i.e. the input and the output signals take the form of currents. This need is fostered by the trend towards lower supply voltages and the search for improved high-frequency performance of the filter systems. The advantages of the current mode over the voltage mode have been mentioned, inter alia, in the article "All current-mode frequency selective circuits", Electronics Letters, Jun. 8, 1989, Vol. 25, No. 12, pp. 759–761.

SUMMARY OF THE INVENTION

It is an object of the invention to provide a tunable transconductor-C integrator which operates in the current mode and which performs a linear integrator function utilising a non-linear transconductor. According to the invention a transconductor-capacitor integrator of the type defined in the opening paragraph is characterized in that

- the input signal and the output signal are an input current and an output current, respectively,
- the transconductor has its input and its output coupled to the capacitor and the output terminal, respectively, to convert a voltage across the capacitor into the output current, and in that the integrator further comprises
- a differentiator for generating a differentiated current which is proportional to the derivative with respect to the voltage across the capacitor of a feedback current proportional to the output current, and
- a current divider is provided for supplying to the capacitor a quotient current proportional to the quotient of the input current at the input terminal and the differentiated current.

The distortion of the output current as a result of the non-linear voltage-to-current characteristic of the transconductor is measured by the differentiator and is supplied as a differentiated current to the current divider which supplies a quotient current, which is proportional to the quotient of the input current and the differentiated current, to the capacitor across which a voltage is built up by integration. The capacitor voltage is converted into the output current by the transconductor. The loop thus formed results in a current integration function which is fully independent of the voltage-to-current characteristic of the transconductor. This characteristic may then be non-linear, for example expanding, so that the quotient current of the current divider will exhibit a compressing characteristic. For a given variation of the output current the variation of the voltage across the capacitor is thus substantially smaller than in the case of a linear transconductor. Such a companding (=compressing and expanding) current-mode integrator is very suitable at low supply voltages.

A first embodiment of a transconductor-capacitor integrator in accordance with the invention is characterized in that the differentiator is a direct current-path between the feedback current and the differentiated current and in that the voltage-to-current conversion of the transconductor has an exponential relationship, the output current being proportional to the exponent of the voltage across the capacitor.

The choice of the exponential relationship enables the differentiator to be reduced to a direct connection so that the differentiated current is equal to the feedback current.

A further simplification can be achieved with a transconductor-capacitor integrator in accordance with the invention which is characterized in that the transconductor comprises a first output transistor having a first and a second main electrode and a control electrode, having its second main electrode coupled to the output terminal, and having a junction formed by the control electrode and the first main electrode (e.g. the base/emitter junction) arranged in parallel with the capacitor.

It is then possible to use a bipolar transistor whose base, emitter and collector correspond to the control electrode, the first main electrode and the second main electrode respectively, or a unipolar MOS transistor operating in the weak inversion mode and whose gate, source and drain correspond to the above electrodes. As is known the relationship between the current through the transistor and the voltage difference between the control electrode and the first main electrode is exponential for both transistor types.

A second embodiment of a transconductor-capacitor integrator in accordance with the invention is characterized in that the transconductor further comprises a second output transistor having a first and a second main electrode and a control electrode, of which the first main electrode and the control electrode are connected to corresponding electrodes of the first output transistor and of which the second main electrode is an output for the feedback current. The feedback current proportional to the output current is then supplied by the second output transistor.

A third embodiment of a transconductor-capacitor integrator in accordance with the invention is characterized in that the current divider comprises:

- a first through fourth transistor, each having a first and a second main electrode and a control electrode, the control electrode of the first transistor being connected to the first main electrode of the second transistor, the control electrodes of the second and the third transistor being interconnected to a node, the first main electrode of the third transistor being connected to the control electrode of the fourth transistor, the control electrode of the first transistor being coupled to the input terminal, the second main electrode of the first transistor being coupled to the node, the first main electrode of the first and the fourth transistor being connected to a first power-supply terminal, and the second main electrodes of the second and the third transistor being coupled to a second power-supply terminal;

a bias current source coupled to the node, a current mirror having a first and a second current terminal coupled to the second main electrode of the fourth transistor and the control electrode of the first output transistor, and in that the first main electrodes of the first and the second output transistor are connected to the first power-supply terminal.

The first through the fourth transistor are arranged in a translinear loop in which the product of the currents through the first and the second transistor is equal to the product of the currents though the third and the fourth transistor. As a result of this the current through the fourth transistor, which is supplied to the capacitor via the current mirror, is proportional to the quotient of the input current and the feedback current. The proportionality constant is defined by the bias current source, whose output current may be controllable to enable the integrator to be tuned.

The current divider can be simplified by interchanging the functions of the third and the fourth transistor in the translinear loop. This yields a fourth embodiment of a transconductor-capacitor integrator, which is characterized in that the current divider comprises a first, a second and a third transistor each having a first and a second main electrode and a control electrode, the control electrode of the first transistor being connected to the first main electrode of the second transistor, the control electrodes of the second and the third transistor being interconnected to a node, the first main electrode of the third transistor being connected to the control electrode of the first output transistor, the control electrode of the first transistor being coupled to the input terminal, the second main electrode of the first transistor being coupled to the node, the first main electrode of the first transistor being connected to a first power-supply terminal, and the second main electrodes of the second and the third transistor being coupled to a second power-supply terminal;

a bias current source coupled to the node, and in that the first main electrode of the first output transistor is connected to the first power-supply terminal. This makes it possible to dispense with the current mirror, the fourth transistor and the second output transistor.

This fourth embodiment may be characterized further in that the integrator further comprises a first and a second further transistor each having a first and a second main electrode and a control electrode, the control electrode and the first main electrode of the first further transistor and of the second further transistor being connected to the corresponding electrodes of the first transistor and of the first output transistor respectively, and the second main electrode of the first further transistor and the second further transistor being coupled to the control electrode of the first output transistor and of the first transistor respectively.

The first and the second further transistor provide a discharge current path for the capacitor. This embodiment results in an integrator operating at very low supply voltages, i.e. two base-emitter junction voltages when bipolar transistors are chosen, and can be cascaded readily because the input and output currents are at compatible voltage levels.

A balanced fourth embodiment of a transconductor-capacitor integrator in accordance with the invention is characterized in that the integrator further comprises a further input terminal for receiving a further input current and a further output terminal for supplying a further output current, a further capacitor whose capacitance is substantially equal to that of the first-mentioned capacitor, a further bias current source for supplying a current which is substantially equal to that of the first-mentioned bias current source, a fourth through sixth transistor, each having first and a second main electrode and a control electrode, the electrodes of the fourth, the fifth and the sixth transistor and of the second output transistor being connected to each other and to the further input terminal, the further output terminal, the further capacitor, the further bias current source, the first power-supply terminal and the second power-supply terminal in a way similar to the corresponding electrodes of the first, the second and the third transistor and the first output transistor respectively, a first group of at least one further output transistor, each transistor having a first main electrode and a control electrode, which are connected to the corresponding electrodes of the first output transistor, and a second main electrode, one of which is coupled to the control electrode of the second output transistor and the other of which are coupled to respective other output terminals for supplying a current which is proportional to the first-mentioned output current, a second group of at least one further output transistor, each transistor having a first main electrode and a control electrode, which are connected to the corresponding electrodes of the second output transistor, and a second main electrode, one of which is coupled to the control electrode of the first output transistor and the other of which to the respective other output terminals for supplying a current which is proportional to the further output current.

This embodiment is suitable for differential input and output currents, has a high common-mode rejection and has input and output currents at compatible voltage levels. This enables this balanced integrator to be cascaded simply to form biquadratic filter sections. Moreover, the input terminals form virtual ground points, enabling an input voltage to be converted simply into an input current by means of series resistors.

BRIEF DESCRIPTION OF THE DRAWING

The invention will now be described in more detail, by way of example, with reference to the accompanying drawings, in which.

In all of these Figures corresponding parts bear the same reference numerals.

DESCRIPTION OF THE PREFERRED EMBODIMENTS

Figure 1:
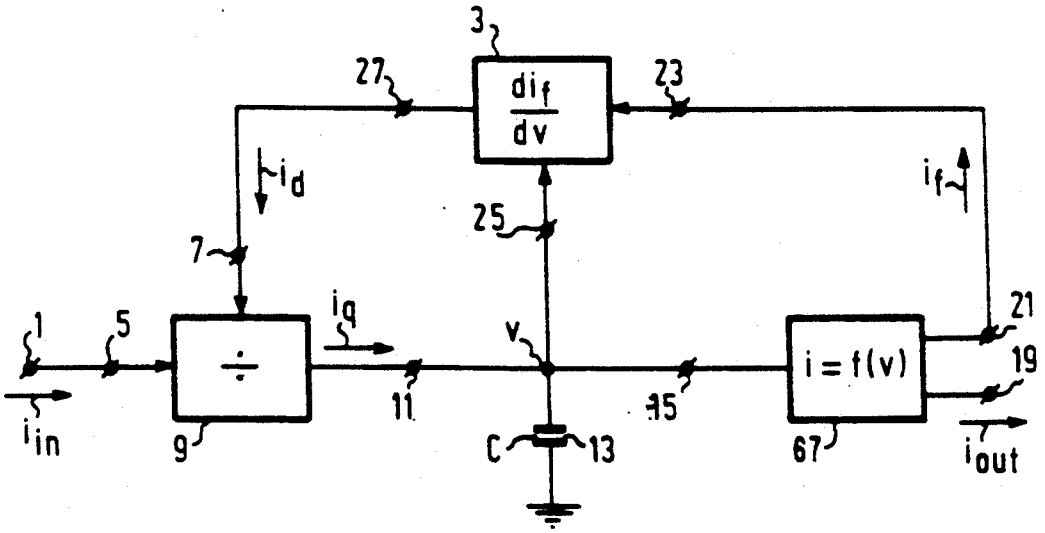
FIG. 1 is the basic diagram of a transconductor-capacitor integrator in accordance with the invention.

FIG. 1 shows the basic diagram of a companding transconductor-C integrator in accordance with the invention. An input current $i_{in}$ to be integrated at an input terminal 1 and a differentiated current $i_d$ from a differentiator 3 are applied to inputs 5 and 7, respectively, of a current divider 9 which produces at its output 11 a quotient current $i_q$ proportional to the quotient of the input current $i_{in}$ and the differentiated current $i_d$ in accordance with:

$$i_q = I_o * (i_{in}/i_d) \tag{1}$$

in which $I_o$ is a constant current.

The output 11 of the current divider 9 is connected to a capacitor 13 having a capacitance C and to the input 15 of a transconductor 67 having an output terminal 19 in which an output current $i_{out}$ flows. The transconductor 67 converts the voltage v across the capacitor 13 into the output current $i_{out}$ in accordance with a voltage-to-current function f(v):

$$i_{out} = f(v) \tag{2}$$

This function is generally non-linear and produces undesirable signal distortion in the output current $i_{out}$. The transconductor also has a second output 21 where it supplies a feedback current $i_f$ proportional or equal to the output current $i_{out}$. The feedback current $i_f$ and the voltage v are applied to the inputs 23 and 25, respectively, of the differentiator 3, at whose output 27 a differentiated current $i_d$ is produced in accordance with:

$$i_d = V_o * (di_f/dv) \tag{3}$$

in which $V_o$ is a constant voltage. Moreover, it is assumed hereinafter that:

$$i_f = i_{out} * K \tag{4}$$

where K is a constant, so that equation (3) becomes:

$$i_d = K * V_o * (di_{out}/dv) \tag{5}$$

The quotient current $i_q$ flows into the capacitor 13, so that by means of equation (1) it is possible to write:

$$i_q = I_o * (i_{in}/i_d) = C * (dv/dt) \tag{6}$$

The chain rule yields:

$$di_{out}/dt = (di_{out}/dv) * (dv/dt) \tag{7}$$

Substitution of the equations (5) and (6) in equation (7) yields:

$$\frac{di_{out}}{dt} = \frac{i_d}{K * V_o} * \frac{i_{in}}{i_d} * \frac{I_o}{C} \tag{8}$$

Integration with respect to time in equation (8) then results in:

$$i_{out} = \frac{I_o}{KV_oC} \int i_{in}\, dt \tag{9}$$

The output current $I_{out}$ is linearly proportional to the integral of the input current $i_{in}$ and is fully independent of the voltage to current function f(v) of the transconductor 67. Signal distortions in the output current $i_{out}$ as a result of non-linearities in the transconductor 67 have been removed. If f(v) is an expanding function the quotient current $i_q$ will have a compressing characteristic. In that case the variation in the voltage v across the capacitor 13 for a given variation of the output current $i_{out}$ will be smaller than in the case of a linear function f(v) of the transconductor. The integrator then behaves as a companding (=compressing and expanding) current-mode integrator and is very suitable for low supply voltages.

Figure 2:
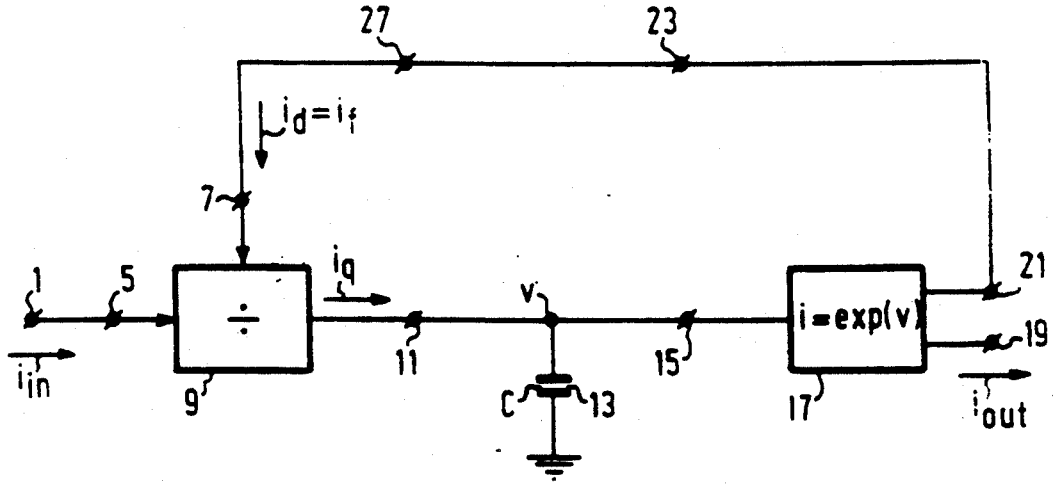
FIGS. 2 and 3 are basic diagrams of embodiments of a transconductor-capacitor integrator in accordance with the invention.

For the function f(v) of the transconductor 67 various functions can be used. A practical choice is that which allows the differentiator to be replaced by a simple interconnection between its input 23 and its output 27, as is shown in FIG. 2. In this case it is required that $$i_d = K * i_{out} \tag{10}$$

Substitution of equation (5) in equation (10) yields:

$$V_o * (di_{out}/dv) = i_{out} \tag{11}$$

and integration of equation (11) with respect to v yields:

$$i_{out} = I_S \exp(v/V_o) \tag{12}$$

where $I_S$ is a constant current.

If an exponential voltage-to-current function is chosen for the transconductor 67 of FIG. 1 it appears that the differentiator may be replaced by an interconnection. A transconductor 17 in FIG. 2 with an exponential transfer function in accordance with equation (12) can be realised with bipolar transistors or with unipolar MOS transistors operating in the weak-inversion mode.

Figure 3A:
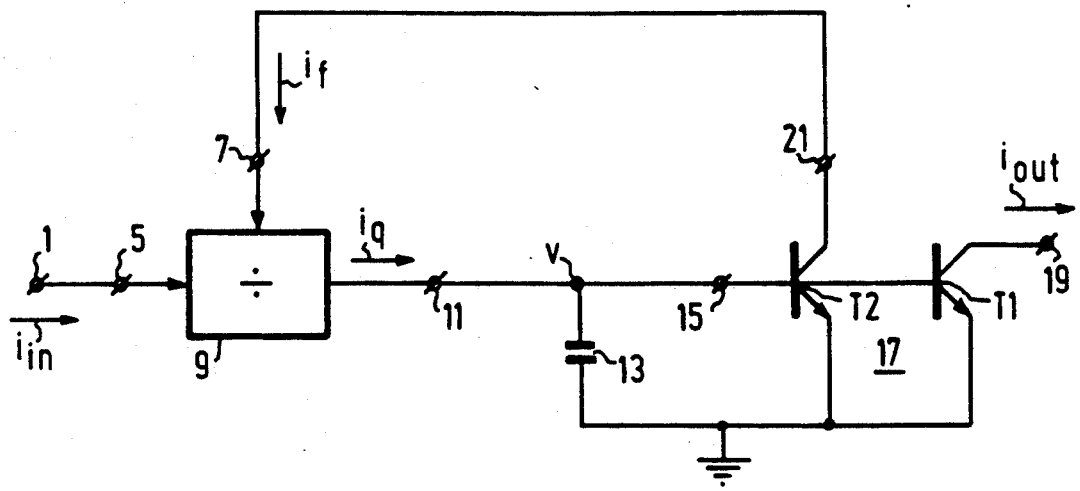
Figure 3B:
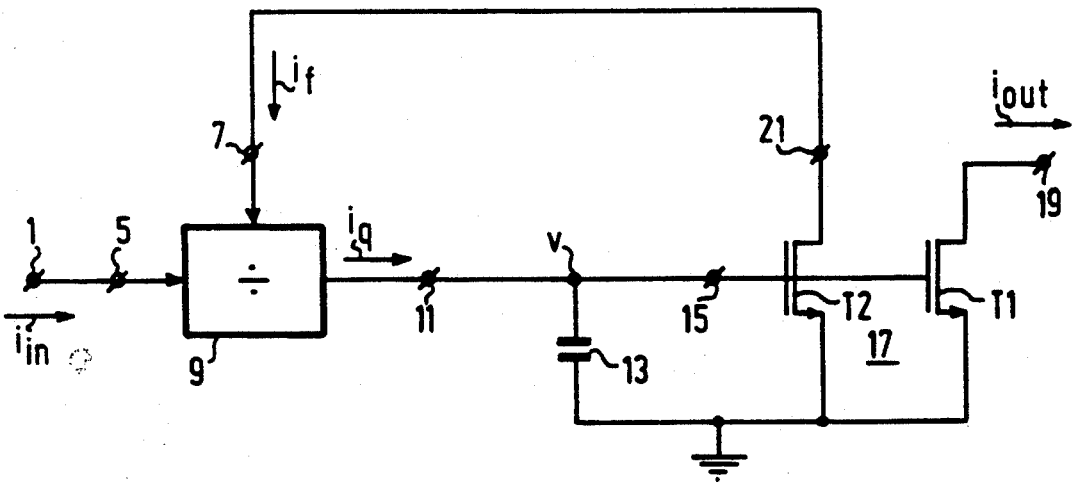

FIG. 3*a* shows an embodiment including a transconductor comprising bipolar transistors and FIG. 3*b* shows an embodiment comprising MOS transistors operating in the weak-inversion mode. In FIG. 3*a* the transconductor 17 comprises a first output transistor T1 and a second output transistor T2 whose base-emitter junctions are arranged in parallel with the capacitor 13. The collector of the first output transistor T1 is coupled to the output terminal 19 and supplies the output current $i_{out}$. The collector of the second output transistor T2 is connected to the output 21 and supplies a current $i_f$ proportional to $i_{out}$ to the input 7 of the current divider 9. The proportionality is defined by the relative dimensions of the transistors T1 and T2. The embodiment shown in FIG. 3*b* is similar to that shown in FIG. 3*a* but comprises a first and a second unipolar MOS transistor operating in the weak-inversion mode and having a gate, source and drain instead of a base, emitter and collector, respectively.

The embodiments described hereinafter are shown only with bipolar transistors. However, in each case the bipolar transistors may be replaced by unipolar MOS transistors operating in the weak-inversion mode, in which case base, emitter and collector should read gate, source and drain, respectively.

Figure 4:
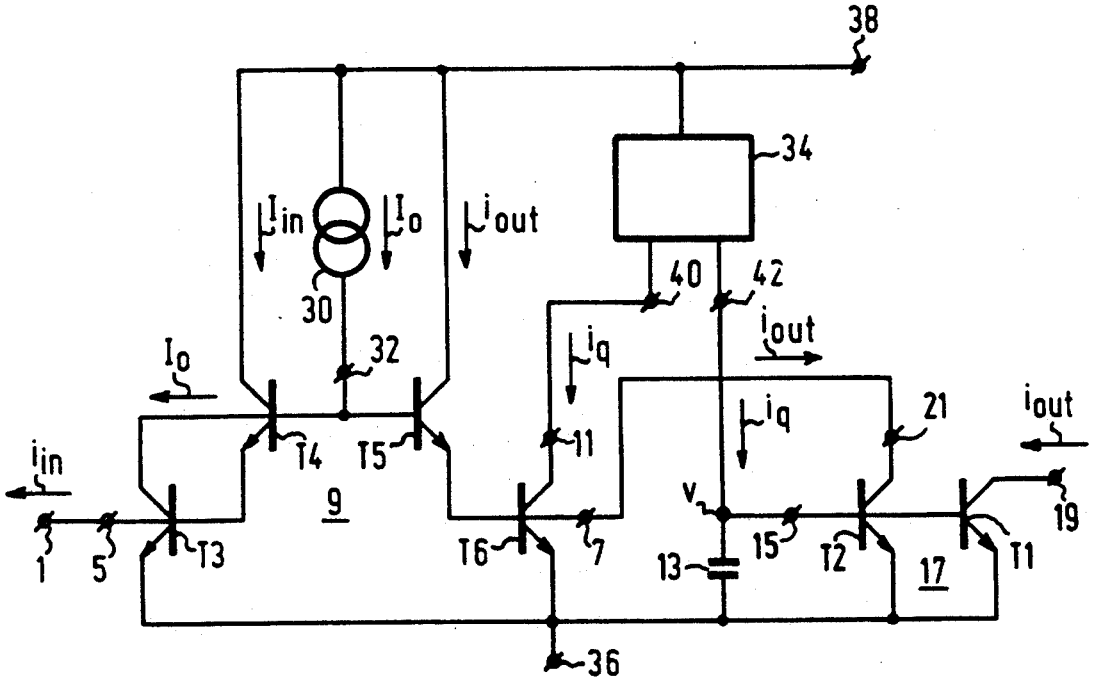
FIGS. 4, 5, 6 and 7 are circuit diagrams of a transconductor-capacitor integrator in accordance with the invention.

FIG. 4 shows a modification of an integrator as shown in FIG. 3a. The current divider 9 comprises a bias current source 30, which supplies a current $I_o$ to a node 32, a current mirror 34 and four transistors T3, T4, T5 and T6 forming a translinear loop, the series arrangement of the base-emitter junctions of the transistors T3 and T4 and the series arrangement of the base-emitter junctions of the transistors T5 and T6 being connected in parallel between the node 32 and a negative power-supply terminal 36. The emitters of the transistors T3 and T6 are connected to the negative power-supply terminal. The bias current source and the collectors of the transistors T4 and T5 are coupled to a positive power-supply terminal 38. The emitter of the transistor T4 and the base of the transistor T3 are connected to the input 5 of the current divider 9, causing the current $i_{in}$ to flow through the transistor T4. The base of the transistor T4 and the collector of the transistor T3 are connected to the node 32, so that the current $i_o$ flows through the transistor T3. The emitter of the transistor T5 and the base of the transistor T6 are connected to the input 7 of the current divider 9, causing a current $i_f$ to flow through the transistor T5, which current by way of example is selected to be equal to $i_{out}$. A first current terminal 40 of the current mirror 34 is coupled to the output 11 of the current divider 9. The output 11 is also coupled to the collector of the transistor T6. A second current terminal 42 of the current mirror 34 is coupled to one terminal of the capacitor 13, whose other terminal is connected to the negative power-supply terminal 36. The quotient current $i_q$ consequently flows through the transistor T6 and through the capacitor 13. It follows from the translinear-loop principle, which is know per se, that the product of the currents through the transistors T3 and T4 is equal to the product of the currents through the transistors T5 and T6:

$$I_o * i_{in} = i_{out} * i_q \tag{13}$$

This is in agreement with equation (6) if $i_d$ is equal to $i_{out}$. The integrator can be tuned by making the bias current source 30 controllable. This follows from equation (6).

Figure 5:
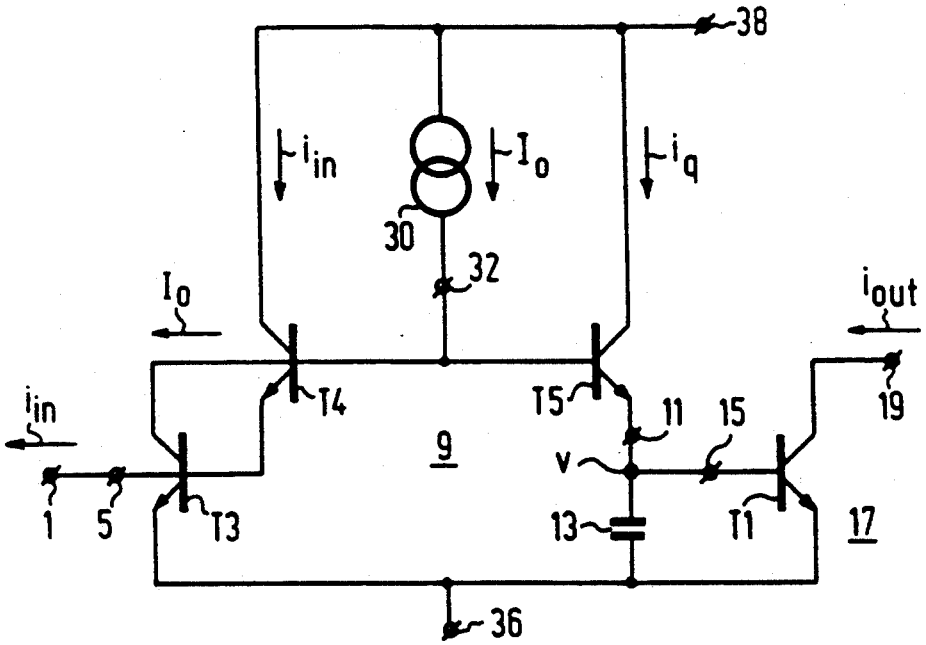

FIG. 5 shows an embodiment derived from that shown in FIG. 4. The transistors T6 and T2 and the current mirror 34 have now been dispensed with. The emitter of the transistor T5 is connected to the output 11 of the current divider and the output 11 is connected directly to the base of the transistor T1 via the input 15 of the transconductor 17. As a result of this, the transistor T1, instead of the transistor T6 in FIG. 4, forms part of the translinear loop. As a consequence the current $i_q$, instead of the current $i_{out}$ as in FIG. 4, now flows through the transistor T5. However, the result remains in compliance with equation (13).

Figure 6:
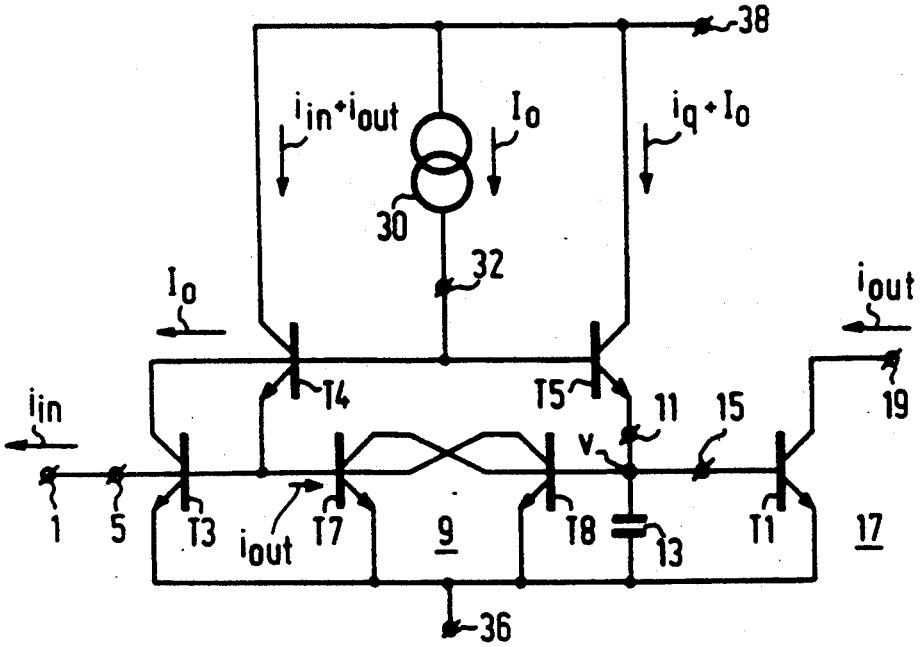

FIG. 6 shows an embodiment in which a discharge path has been provided for the capacitor 13. Two transistors T7 and T8 have been added to the integrator shown in FIG. 5. The base-emitter junctions of the transistors T7 and T8 are arranged in parallel with those of the transistors T3 and T1, respectively, so that the collector current of the transistor T7 is equal to that of T3, i.e. $I_o$, and the collector current of the transistor T8 is equal to that of the transistor T1, i.e. $i_{out}$. The collector of the transistor T7 is connected to the base of the transistor T1 and the collector of the transistor T8 is connected to the base of the transistor T3. This results in a current $i_{in}+i_{out}$ flowing through the transistor T4 and a current $i_q+I_o$ flowing through the transistor T5. Consequently, the following equation is valid:

$$I_o * (i_{in} + i_{out}) = i_{out} * (i_q + I_o) \tag{14}$$

Both members of equation (14) comprise a common term $I_o * i_{out}$, so that equation (14) is in principle identical to equation (13).

Figure 7:
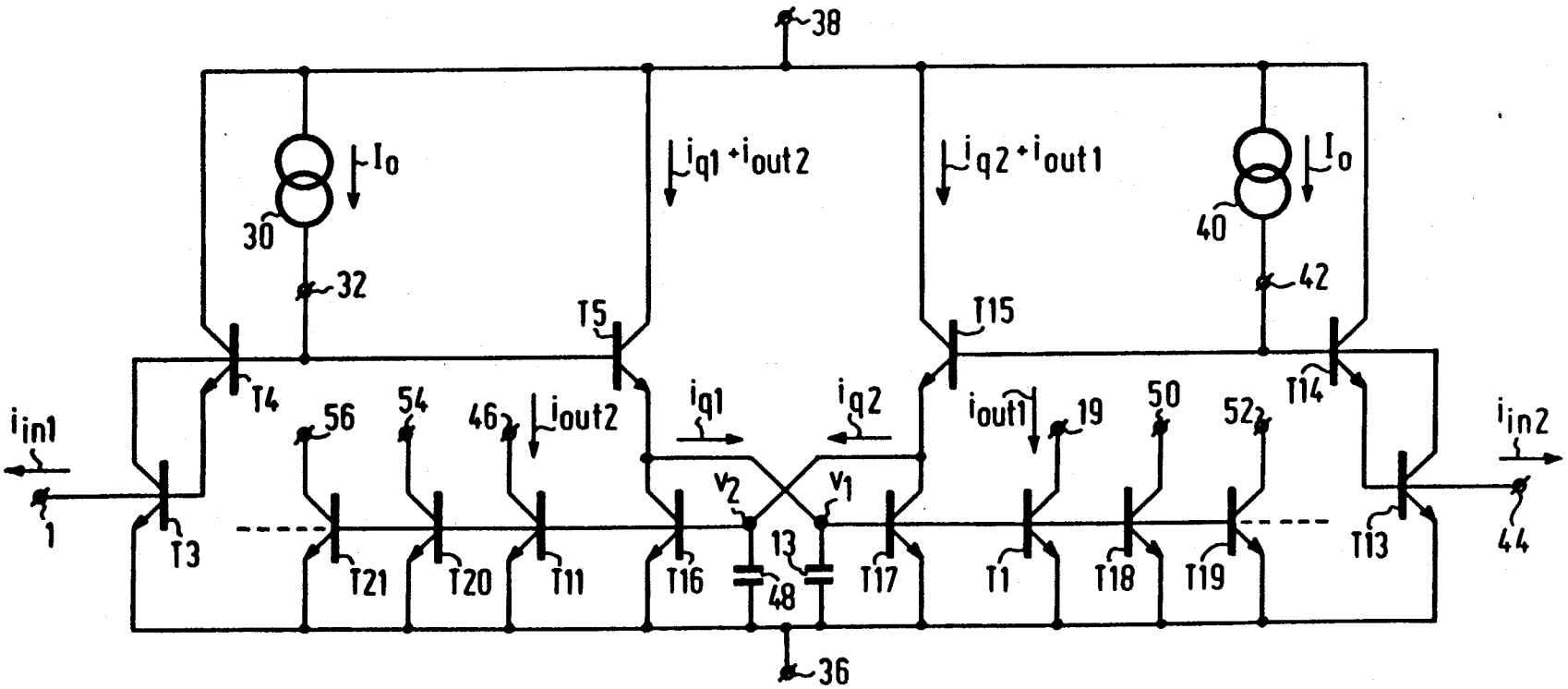

FIG. 7 shows a balanced integrator having input terminals 1 and 44 for receiving balanced input currents $i_{in1}$ and $i_{in2}$ and output terminals 19 and 46 for supplying balanced output currents $i_{out1}$ and $i_{out2}$. The balanced integrator comprises two integrators of the type as shown in FIG. 5, one integrator being identical to that shown in FIG. 5 and the other integrator comprising a capacitor 48, a bias current source 40, the transistors T11, T13, T14 and T15, the input terminal 44 and the output terminal 46 which are connected to each other and to the positive power-supply terminal 38 and the negative power-supply terminal 36 in the same way as the corresponding capacitor 13, the bias current source 30, the transistor T1, T3, T4 and T5, the input terminal 1 and the output terminal 19 of the one integrator. In addition, it comprises a transistor T16 whose base-emitter junction is arranged in parallel with that of the transistor T11 and whose collector is connected to the base of the transistor T1, and a transistor T17 whose base-emitter junction is arranged in parallel with that of the transistor T1 and whose collector is connected to the base of the transistor T11.

A voltage $v_1$ appears across the capacitor 13 and a voltage $v_2$ across the capacitor 48, which is assumed to be equal. A current $i_{q1}$ flows through the capacitor 13 and a current $i_{q2}$ through the capacitor 48. If the transistors T16 and T17 are assumed to be identical to the transistors T11 and T1, although this is not essential, currents $i_{q1}+i_{out2}$ and $i_{q2}+i_{out1}$ will flow through the transistors T5 and T15 respectively.

The translinear loop T3, T4, T5 and T16 complies with:

$$I_{in1} * I_o = i_{out1} * (i_{out2} + i_{q1}) \tag{15}$$

The tranlinear loop T13, T14, T15 and T17 complies with:

$$I_{in2} * I_o = i_{out2} * (i_{out1} + i_{q2}) \tag{16}$$

Subtracting equations (15) and (16) from one another and equating the difference current $i_{in1}-i_{in2}$ with $i_{in}$ and the difference current $i_{out1}-i_{out2}$ with $i_{out}$ yields a result similar to that in equation (13).

Owing to the translinear principle the transistor currents can assume values far below their quiescent values, which enables a large dynamic output swing to be obtained. Common-mode currents are rejected and the integrator can be cascaded simply because the voltages on the input and output terminals are compatible. The input terminals 1 and 44 are virtual ground points, so that input voltage sources can be coupled simply via resistors.

The circuits shown in FIGS. 5, 6 and 7 already operate at very low supply voltages because they comprise only two base-emitter junctions between the power-supply terminals.

Figure 8:
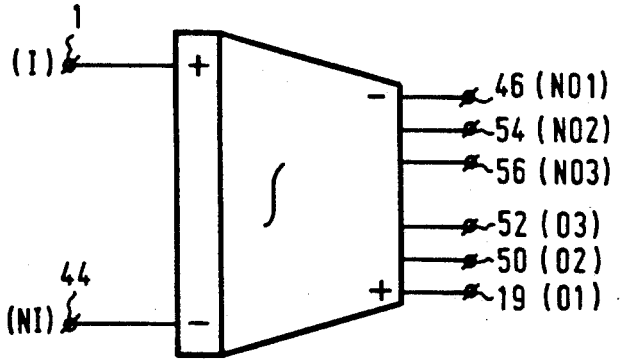
FIG. 8 is a symbolic representation of the transconductor-capacitor integrator shown in FIG. 7.

By arranging additional transistors in parallel with the transistor T1 in the integrators shown in FIGS. 4, 5, 6 and 7 and in parallel with the transistor T11 in FIG. 7 the number of current outputs can be increased. The individual output currents can be weighted by suitably scaling the dimensions of the parallel transistors. In the balanced integrator shown in FIG. 7 these additional transistors bear the references T18 and T19, which have their base-emitter junctions arranged in parallel with that of the transistor T1 and their collectors connected to the additional output terminals 50 and 52 respectively, and T20 and T21, which have their base-emitter junctions arranged in parallel with that of the transistor T11 and their collectors connected to the additional output terminals 54 and 56, respectively. This balanced transconductor-C integrator is shown symbolically in FIG. 8. The terminal 1 is the input I, the terminal 44 is the inverting input NI, the terminals 46, 54, 56 are the inverting outputs NO1, NO2, NO3, and the terminals 19, 50, 52 are the outputs O1, O2, O3.

Figure 9:
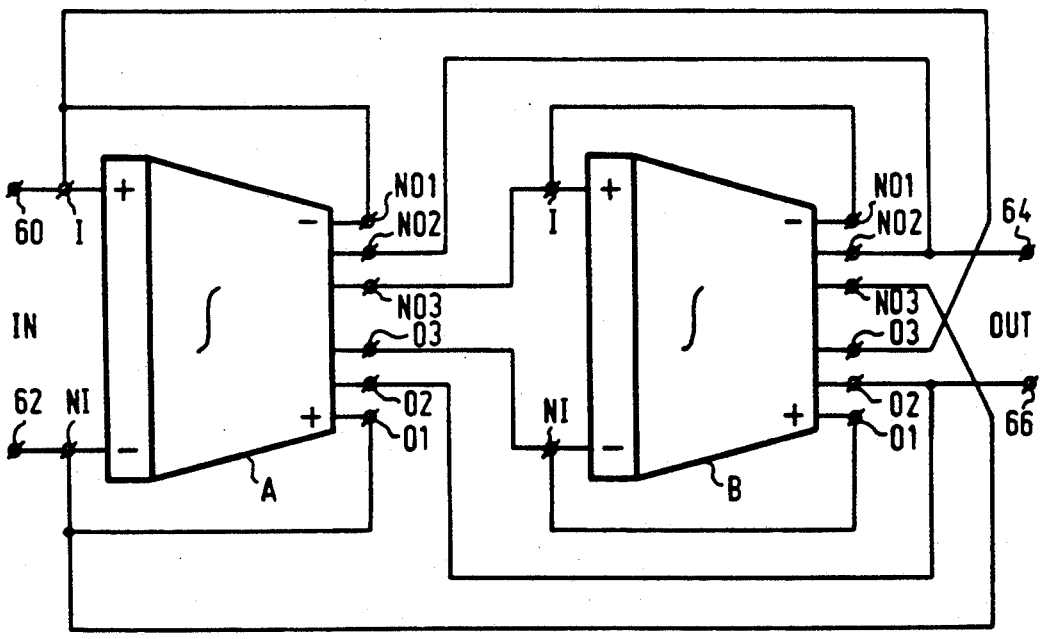
FIG. 9 shows a biquadratic filter section comprising two transconductor-capacitor integrators in accordance with the invention.

FIG. 9 shows an example employing two balanced integrators A and B by means of which a biquadratic filter section is realized. The coefficients of the biquadratic filter function are dictated by the ratios of the transistor dimensions. Positive coefficients are obtained through summation of signal currents by combining in-phase currents. Negative coefficients are obtained through subtraction of signal currents by combining anti-phase currents. The input signal is applied to the filter input terminals 60 and 62. The output signal can be taken from the filter output terminals 64 and 66. The terminals I and NI of the integrator A are connected, each time in the same sequence, to the filter input terminals 60 and 62, the terminals NO1 and O1 of the integrator A and the terminals O3 and NO3 of the integrator B. The terminals NO2 and O2 of the integrator A and the terminals NO2 and O2 of the integrator B are connected to the filter output terminals 64 and 66. The terminals NO3 and O3 of the integrator A are connected to the terminals I and NI of the integrator B and to the terminals NO1 and O1 of the integrator B.

The frequency response characteristic of the biquadratic filter section is defined by the coefficients and also by the values of the capacitors 13 and 48 and the magnitudes of the currents $I_o$ of the bias current sources 30 and 40 in the circuit shown in FIG. 7. The filter characteristic of the biquadratic section can be tuned by making the current sources 30 and 40 controllable.

I claim:

1. A transconductor-capacitor integrator for generating at least one output signal which is proportional to the integral of an input signal, which integrator comprises: an input terminal for receiving the input signal, an output terminal for supplying the output signal, a capacitor, a transconductor having an input and an output, wherein the input signal and the output signal are an input current and an output current, respectively, and the transconductor has its input and its output coupled to the capacitor and to the output terminal, respectively, to convert a voltage across the capacitor into the output current, a differentiator having a voltage input, a current input, and an output at which is generated a differentiated current which is proportional to the derivative with respect to a voltage supplied to the voltage input of a current supplied to the current input, means for supplying to the current input a feedback current proportional to the output current, means for supplying to the voltage input said capacitor voltage, and a current divider responsive to the input current and the differentiated current for supplying to the capacitor a quotient current proportional to the quotient of the input current at the input terminal and the differentiated current.

2. A transconductor-capacitor integrator for generating at least one output signal current which is proportional to the integral of an input signal current and which comprises:

an input terminal for receiving the input signal current, an output terminal for supplying the output signal current, a capacitor, a transconductor having an input coupled to the capacitor and an output coupled to the output terminal thereby to convert a voltage across the capacitor into the output signal current, said transconductor having an exponential voltage-to-current conversion characteristic such that the output signal current is exponentially proportional to the capacitor voltage, and a current divider having a first input coupled to the input terminal, a second input coupled to the transductor to receive therefrom a feedback current proportional to the output signal current, and an output coupled to the capacitor to supply to the capacitor a quotient current proportional to the quotient of the input signal current and the feedback current.

3. An integrator as claimed in claim 2, wherein the transconductor comprises a first output transistor having a first and a second main electrode and a control electrode, having its second main electrode coupled to the output terminal, and having a junction formed by the control electrode and the first main electrode connected in parallel with the capacitor.

4. An integrator as claimed in claim 3, wherein the transconductor further comprises a second output transistor having a first and a second main electrode and a control electrode, of which the first main electrode and the control electrode are connected to corresponding electrodes of the first output transistor and of which the second main electrode is an output for the feedback current.

5. An integrator as claimed in claim 4, wherein the current divider comprises:

first, second, third and fourth transistors each having a first and a second main electrode and a control electrode, the control electrode of the first transistor being connected to the first main electrode of the second transistor, the control electrodes of the second and the third transistor being interconnected to a node, the first main electrode of the third transistor being connected to the control electrode of the fourth transistor, the control electrode of the first transistor being coupled to the input terminal, the second main electrode of the first transistor being coupled to the node, the first main electrodes of the first and the fourth transistors being connected to a first power-supply terminal, and the second main electrodes of the second and the third transistors being coupled to a second power-supply terminal;

a bias current source coupled to the node, a current mirror having first and second current terminals coupled to the second main electrode of the fourth transistor and the control electrode of the first output transistor, respectively, and wherein the first main electrodes of the first and the second output transistors are connected to the first power-supply terminal.

6. An integrator as claimed in claim 3, wherein the current divider comprises a first, a second and a third transistor each having a first and a second main electrode and a control electrode, the control electrode of the first transistor being connected to the first main electrode of the second transistor, the control electrodes of the second and the third transistor being interconnected to a node, the first main electrode of the third transistor being connected to the control electrode of the first output transistor, the control electrode of the first transistor being coupled to the input terminal, the second main electrode of the first transistor being coupled to the node, the first main electrode of the first transistor being connected to a first power-supply terminal, and the second main electrodes of the second and the third transistors being coupled to a second power-supply terminal;

a bias current source coupled to the node, and wherein the first main electrode of the first output transistor is connected to the first power-supply terminal.

7. An integrator as claimed in claim 6, which further comprises: first and second further transistor each having first and second main electrodes and a control electrode, the control electrode and the first main electrode of the first further transistor and of the second further transistor being connected to corresponding electrodes of the first transistor and of the first output transistor respectively, and the second main electrode of the first further transistor and the second further transistor being coupled to the control electrode of the first output transistor and of the first transistor, respectively.

8. An integrator as claimed in claim 6, which further comprises:

a further input terminal for receiving a further input signal current and a further output terminal for supplying a further output signal current, a second output transistor having a first main electrode coupled to the first power supply terminal, a second main electrode coupled to the further output terminal, and a control electrode, a further capacitor connected in parallel to a junction formed by the control electrode and the first main electrode of the second output transistor and having a capacitance which is substantially equal to that of the first capacitor, fourth, fifth and sixth transistors, each having a first and a second main electrode and a control electrode, the control electrode of the fourth transistor being connected to the first main electrode of the fifth transistor, the control electrodes of the fifth and the sixth transistors being interconnected to a further node, the first main electrode of the sixth transistor being connected to the control electrode of the second output transistor, the control electrode of the fourth transistor being coupled to the further input terminal, the second main electrode of the fourth transistor being coupled to the further node, the first main electrode of the fourth transistor being connected to the first power-supply terminal, and the second main electrodes of the fifth and the sixth transistors being coupled to the second power-supply terminal, a further bias current source coupled to the further node, a first group of further output transistors, each further output transistor having a first main electrode and a control electrode connected to corresponding electrodes of the first output transistor, and having a second main electrode, the second main electrode of one of the further output transistors of the first group being coupled to the control electrode of the second output transistor, the second main electrodes of the remaining further output transistors of the first group being coupled to respective further output terminals for supplying currents which are proportional to the first output signal current, a second group of further output transistors, each further output transistor having a first main electrode and a control electrode connected to corresponding electrodes of the second output transistor, and having a second main electrode, the second main electrode of one of the further output transistors of the second group being coupled to the control electrode of the first output transistor, the second main electrodes of the remaining further output transistors of the second group being coupled to respective further output terminals for supplying currents which are proportional to the further output signal current.

9. An integrator as claimed in claim 3, wherein the first output transistor comprises a bipolar transistor, the control electrode, the first main electrode and the second main electrode corresponding to the base, the emitter and the collector, respectively.

10. An integrator as claimed in claim 3, wherein the first output transistor comprises a unipolar MOS transistor operating in the weak-inversion mode, the control electrode, the first main electrode and the second main electrode corresponding to the gate, the source and the drain, respectively.

11. An integrator as claimed in claim 5, wherein the bias current source supplies a current whose magnitude is controllable.

12. A filter arrangement comprising first and second integrators with each integrator as claimed in claim 8, first and second complementary filter input terminals and first and second complementary filter output terminals, each of the integrators having a non-inverting and a complementary inverting input which correspond to said first-mentioned input terminal and the further input terminal respectively, and having a first, second and third non-inverting output corresponding to the first output terminal and two further output terminals respectively coupled to the second main electrodes of two further output transistors of the first group and having a first, second and third inverting output complementary to the first, second and third non-inverting output, respectively, and corresponding to the further output terminal and two further output terminals respectively coupled to the second main electrode of two further output transistors of the second group, the non-inverting input and the first inverting output of the first integrator and the third non-inverting output of the second integrator being connected to the first filter input terminal, the inverting input and the first non-inverting output of the first integrator and the third inverting output of the second integrator being connected to the second filter input terminal, the second inverting output of the first and of the second integrator being connected to the first filter output terminal, the second non-inverting output of the first and the second integrator being connected to the second filter output terminal, the third inverting output of the first integrator being connected to the non-inverting input and the first inverting output of the second integrator, the third non-inverting output of the first integrator being connected to the inverting input and the first non-inverting output of the second integrator, thereby constituting a filter section having a biquadratic transfer function whose coefficients are defined by the relative dimensions of the transistors in the integrators.

13. An integrator as claimed in claim 6 wherein the bias current source supplies a current whose magnitude is controllable.

14. An integrator as claimed in claim 7 wherein the bias current source supplies a current whose magnitude is controllable.

15. A current integrator for deriving an output signal current proportional to the integral of an input signal current comprising:

an input terminal for receiving the input signal current, an output terminal for supplying the output signal current, a capacitor, a transconductor having an input coupled to the capacitor and an output coupled to the output terminal thereby to convert a voltage across the capacitor into the output signal current, said transconductor having a non-linear voltage-to-current conversion characteristic, a differentiator having a voltage input coupled to the capacitor, a current input coupled to said transductor to receive a feedback current from the transductor, and an output which derives a differentiated current proportional to the derivative of the feedback current at its current input with respect to the capacitor voltage received at its voltage input, said feedback current being proportional to the output signal current, and a current divider having a first input coupled to the input terminal, a second input coupled to the output of the differentiator and an output coupled to the capacitor to supply to the capacitor a quotient current proportional to the quotient of the input signal current and the differentiated current.

16. An integrator as claimed in claim 5 wherein the first, second, third and fourth transistors together form a translinear circuit.

* * * * *